United States Patent [19]

Visman

[11] 4,133,747

[45] Jan. 9, 1979

[54] METHOD FOR PROCESSING RAW COAL

[75] Inventor: Jan Visman, Edmonton, Canada

[73] Assignee: Canadian Patents & Development Limited, Ontario, Canada

[21] Appl. No.: 874,499

[22] Filed: Feb. 2, 1978

Related U.S. Application Data

[63] Continuation of Ser. No. 732,493, Oct. 14, 1976, abandoned, which is a continuation-in-part of Ser. No. 633,983, Nov. 20, 1975, abandoned, which is a continuation-in-part of Ser. No. 550,553, Feb. 18, 1975, abandoned.

[51] Int. Cl.[2] ..... B03B 9/00

[52] U.S. Cl. ..... 209/10; 209/5; 209/17

[58] Field of Search ..... 209/3, 5, 10, 12, 17, 209/211; 210/54, 53, 51, 43, 42 R, 512 R, 49

[56] References Cited

U.S. PATENT DOCUMENTS

| | | | |
|---|---|---|---|
| Re. 26,720 | 11/1969 | Visman | 209/211 |
| 2,724,503 | 11/1955 | Fontein | 209/211 |
| 3,045,818 | 7/1962 | Muschenborn et al. | 209/5 |
| 3,366,247 | 1/1968 | Visman | 209/211 X |
| 3,408,293 | 10/1968 | Dajani et al. | 209/5 X |
| 3,487,923 | 1/1970 | Visman et al. | 209/211 X |
| 3,856,668 | 12/1974 | Shubert | 209/5 X |

FOREIGN PATENT DOCUMENTS

| | | | |
|---|---|---|---|
| 876860 | 7/1971 | Canada | 209/5 |

*Primary Examiner*—Frank W. Lutter
*Assistant Examiner*—Ralph J. Hill
*Attorney, Agent, or Firm*—Fidelman, Wolffe & Waldron

[57] ABSTRACT

A method and apparatus for beneficiating crushed raw coal comprising: cleaning the crushed coal in bulk in cyclone separators using only water as a cleaning medium and obtaining a product of wet clean coal and wet reject material and also a stream of effluent; drying said wet clean coal and wet reject material by agglomerating after the addition of a small amount of oil and then centrifuging to obtain a product of clean dry coal and solid reject material and also a stream of effluent; treating the effluent stream from the cleaning step and the effluent stream from the drying step by means of flocculation to recover a product of coal and reject sludge which is returned to pass through the drying step again; and thus obtain clean water which is recycled and applied to the input of the cyclones in the cleaning step.

10 Claims, 2 Drawing Figures

LEGEND

SORTER — PRODUCT STREAM

SIZER — PROCESS WATER

METHOD FOR PROCESSING RAW COAL

This is a continuation, of application Ser. No. 732,493, filed Oct. 14, 1976, now abandoned, which is a continuation-in-part of application Ser. No. 633,983, filed Nov. 20, 1975 (now abandoned), which is a continuation-in-part of application Ser. No. 550,553, filed Feb. 18, 1975 (now abandoned).

This invention relates to a method and apparatus of upgrading crushed raw coal especially raw coal having a high proportion of finely divided particles and impurities including clay.

At the present time, in the processing of coal in bulk, that is without prior sizing, granulometric separation may be accomplished by various washing units where maximum recovery in the preparation plant is not of prime importance. Selective processing of size fractions is routinely practiced in order to reduce the adverse effect of a wide particle size range on the overall efficiency of the sorting operation (gravimetric separation). For example, it is common practice to screen the crushed raw coal at approximately ½ in. and at 28 mesh, and to process the coarse fraction (plus ½ in.) by jigging; the ½ in. by 28 mesh fraction in HM cyclones; and the minus 28 mesh slimes fraction by froth flotation. Other objectives of selective (parallel) processing are, to limit the thermal drying operation to the small fractions, e.g. the dewatered fine coal and filter cake, and to keep the build-up of recirculating slimes at a minimum.

The main limitation of washing units operating under the influence of gravity only, is that the presence of clay and fine coal slimes caused by degradation (friable coal) and build-up of recirculating fine solids tends to affect the efficiency of the gravity separation more than it affects centrifugal separators. A limitation of heavy-medium separators is that the recovery of the medium e.g. magnetite, is adversely affected by the presence of finely divided solids. A commonly used method for controlling slimes content under these circumstances is, to use large quantities of make-up water and to discard washery effluents containing finely divided solids to slurry settling ponds, with the attendant loss of saleable product and problems of pollution and environmental control.

It is an object of the present invention to provide a method of beneficiating raw coal in bulk that effectively sorts and sizes the coal and removes to a high degree the unwanted slimes.

It is another object of the invention to provide a method of beneficiating raw coal that provides a product of clean coal and a reject material in solid or near solid form that can be readily disposed of.

It is another object of the invention to provide a method of beneficiating raw coal that does not require settling ponds and therefor does not give rise to possible pollution or contamination of the earth, lakes and streams in the region.

It is another object of the invention to provide a method of beneficiating raw coal that lends itself to modular plant design for ready and quick construction, transportation, and location of processing plants.

These and other objects are achieved by a method and apparatus for beneficiating crushed raw coal comprising: cleaning the crushed coal in bulk cyclone separators using only water as a cleaning medium and obtaining a product of wet clean coal and wet reject material and also a stream of effluent; drying said wet clean coal and wet reject material, the coal by agglomerating after the addition of small amount of oil; and then screening and centrifuging to obtain a product of clean dry coal and solid reject material and also a stream of effluent; treating the effluent stream from the cleaning step and the effluent stream from the drying step by recleaning in compound water cyclones using only water as a cleaning medium and obtaining a product of finely divided clean coal in the form of a sludge and a stream of effluent containing finely divided solids mainly reject; treating the clean coal sludge by returning it to the drying section for oil agglomeration and centrifuging; and treating the reject effluent by means of flocculation to recover a product of reject sludge; drying said reject sludge by centrifuging to obtain a product of solid reject material for disposal and also a stream of reject effluent which is returned to pass through the flocculating step again; and thus obtaining clean water which is recycled and applied to the input of the cyclones in the cleaning step.

The apparatus for the process comprises:

(a) a feed preparation section, where the raw coal is crushed in preparation for cleaning and where a middlings product may be selectively ground to liberate intergrown coal from shale, slate, or similar non-combustible matter;

(b) a cleaning section where the crushed feed from the preparation section is cleaned in bulk using only water as a medium, the products being dewatered prior to drying; the larger portion of the medium or effluent being recirculated internally and the smaller portion, about ¼ to ½ depending on clay content, being recleaned and then sent to a water recovery section;

(c) a drying section where the predewatered end products (coal and reject) leaving the plant are dried by centrifugal force after agglomeration with oil of the very fine coal slimes present, the coal effluent being sent back to the cleaning section and the reject effluent going to the water recovery section; and (d) a water recovery section, where the medium containing finely divided solids mainly reject is reconstituted by removal of the majority of the solids by flocculation, the solids being sent to the drying section in the form of a sludge, and the reconstituted medium being returned to the cleaning section where it is re-used for cleaning.

In the drawings which illustrate an embodiment of the invention,

Figure 1:
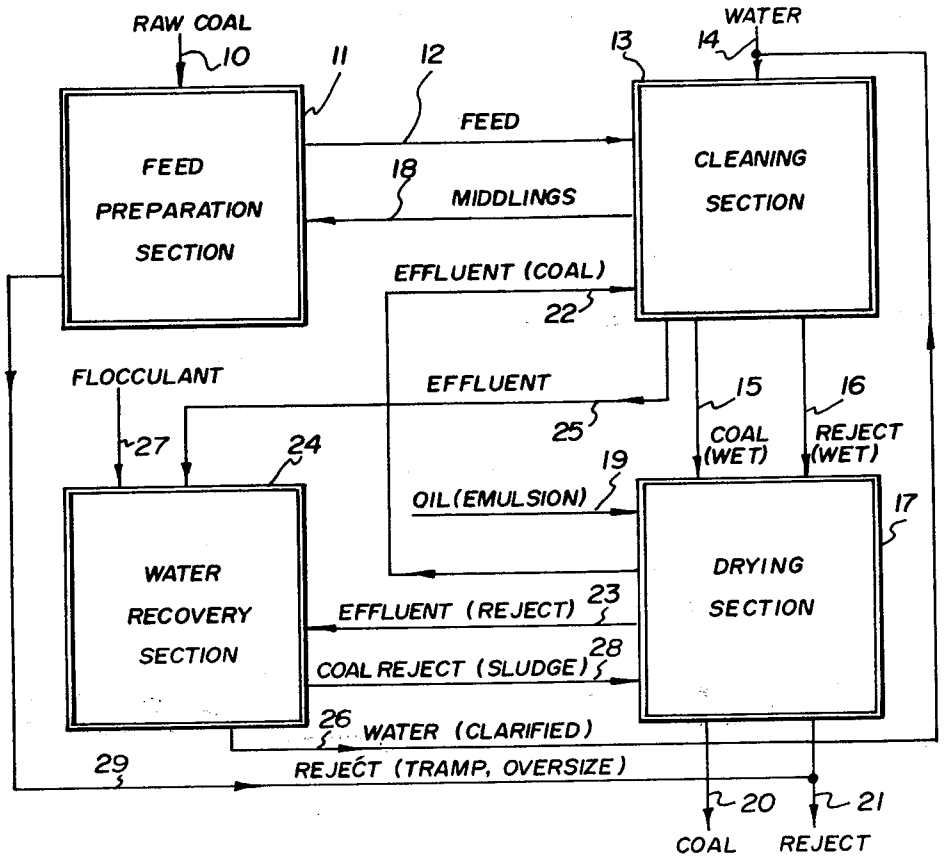
FIG. 1 is a general flowsheet of the process.

Referring to FIG. 1, a general flowsheet for a coal processing plant according to the invention is shown. Raw mine-run coal 10 is introduced to a feed preparation section 11 where it is crushed in preparation for cleaning and delivered as washery feed 12 to cleaning section 13. In the cleaning section, the coal is mixed with water 14 and fed to a system of one or more cyclones, preferably compound water cyclones as disclosed in U.S. Pat. No. RE 26,720 issued to Jan Visman on Nov. 29, 1969. These act as sorters providing an output of wet clean coal 15 and a wet reject product 16 which are fed separately to drying section 17. A middlings product 18 may also be produced and this may be returned to the feed preparation section where it is selectively ground and reintroduced (recycled) into the feed to the cleaning section. In the drying section, the coal and the reject product have oil 19, preferably a fuel oil, added to them to agglomerate the very fine coal slimes present and then are dried by centrifugal action giving a dry clean coal product 20 and a reject product 21 in solid or close to solid form. This latter waste material can be disposed of very readily and there is no need for settling ponds. A coal effluent 22 in slurry form is returned to the cleaning section and a reject effluent 23 is delivered to water recovery section 24. A reject effluent stream 25 from the cleaning section is also fed to the water recovery section.

In the water recovery section, clarified water 26 is obtained from the input by the addition of a flocculant 27 which removes the majority of the solids by flocculation and these solids are returned as a reject 28 to the drying section. The clarified water is returned to the input of the cleaning section. A reject product 29 which will be tramp or oversize reject will be obtained from the feed preparation section and this is sent directly to reject.

Figure 2:
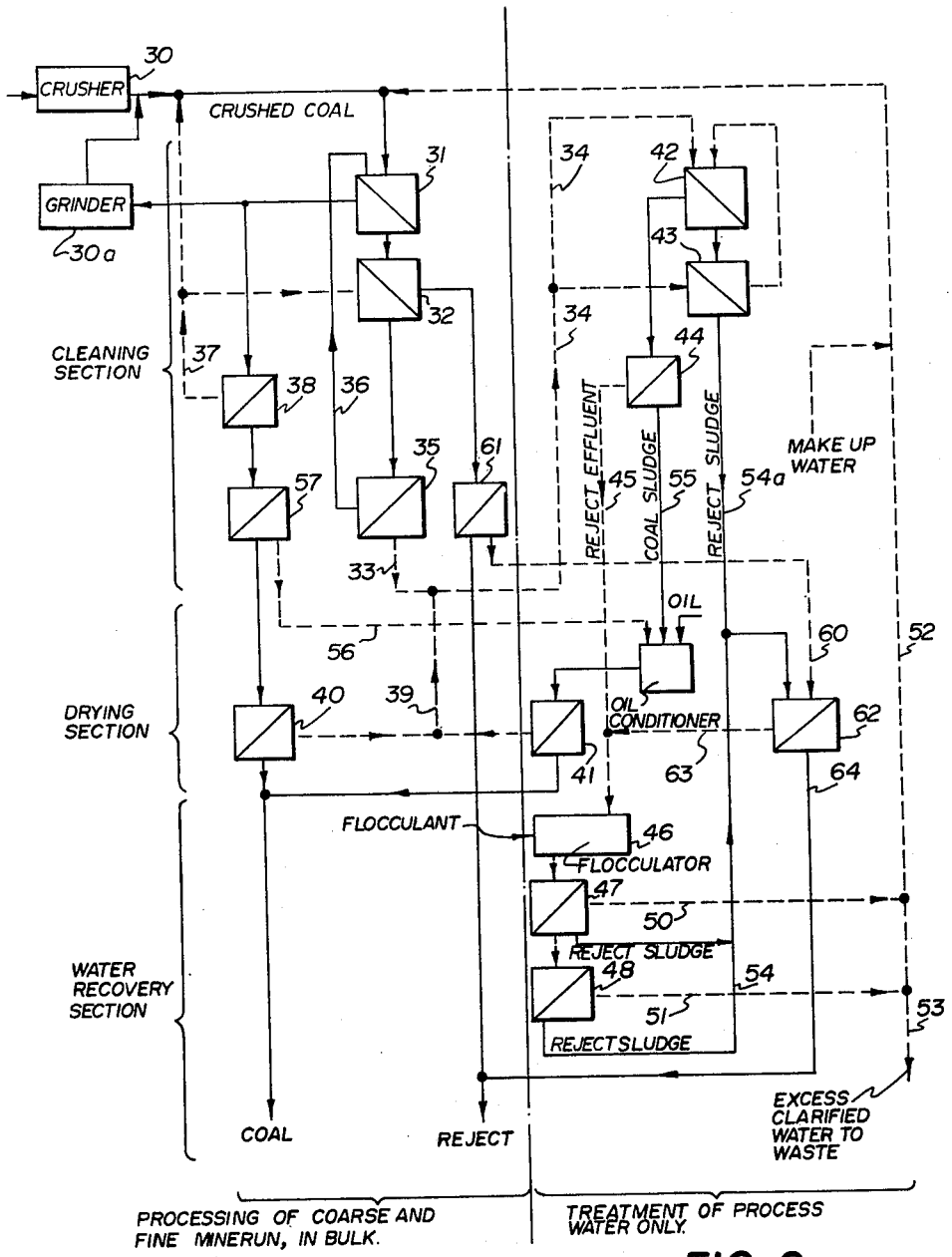
FIG. 2 is a more specific flowsheet of the process of FIG. 1.

Referring to FIG. 2, the mine run coal is crushed in crusher 30 and the crushed coal is sent to the cleaning section.

The intrasectional structure used for processing the raw coal and treating the recirculating process water is located in the latter three sections, the apparatus consisting of sorters (gravimetric separators) and sizers (granulometric separators) for processing the raw coal in bulk (as shown on the left hand side of the flowsheet) and for treatment of the process water (as shown on the right hand side). In a typical application of the process, the process water (broken lines) is separated from the product streams (solid lines) by means of sizers in each section of the structure, and a portion, say one-third of the water entering the sorters of the cleaning through compound water cyclones 31 and 32, is sent to the process water treatment side (the right hand side of FIG. 2) as indicated by line 33 representing the effluent of middlings dewatering screen 35 which has a recycle product returned to cyclone 31 via line 36 directly or alternatively through grinder 30*a;* while the major portion of the process water returns directly to sorters 31 and 32 as shown by line 37 via classifier cyclone 38. Smaller portions of process water with fine solids (line 39) generated in the drying section (centrifuges 40, 41) are returned to the cleaning section for recleaning in compound water cyclones 42 and 43; the clean fine coal being substantially removed from the effluent by sizer (classifier cyclone 44); the reject effluent (line 45) being sent to the water recovery section where clay and other very finely divided particles are flocculated in flocculator 46, the flocs being removed in a sizer 47 (e.g. a pulp divider and/or a slugging cyclone of the type shown in U.S. Pat. No. 3,366,247) and static thickener 48; the clarified process water being returned to the feed end of the plant via lines 50, 51 and 52; any excess clarified water being discharged to the environment (line 53). Reject sludge material from sizers 47 and 48 is sent (via line 54) to a high-speed centrifuge 62.

The clean coal sludge of classifier cyclone 44 (line 55) along with a process water stream 56 from dewatering screen 57 between classifier cyclone 38 and coarse coal centrifuge 40 is given an agglomeration treatment in oil conditioner 58 before being applied to fine coal centrifuge 41. Reject material from compound water cyclones 42 and 43 are fed, along with reject effluent (line 60) from dewatering screen 61 connected to the reject output of cyclones 32 to centrifuge 62. This centrifuge gives a finished reject product 64 and also process water (line 63) which is sent to flocculator 46.

In operation, the apparatus according to the above principles effectively performs at zero discharge of pollutants in continuous process by cleaning crushed raw coal in bulk using suitable sorting and sizing apparatus; recycling all process water; diverting a portion of the solids-laden process water or effluent recirculating within the cleaning section and recleaning it in sorting apparatus suitable for recovering clean coal from the very finely divided solids contained in the process water and removing it from the process water by classification using suitable sizing apparatus including screens, classifier cyclones and centrifuges in conjunction with oil agglomeration for the fine coal. The process water with remaining fine solids (clay, etc.) is subsequently passed through a cyclonic flocculator-clarifier system preferably as disclosed in U.S. Pat. Ser. No. 3,929,633 issued Dec. 30, 1975, to Jan Visman and Hassan A. Hamza for the removal of other finely divided solids by means of suitable sizers including classifier cyclones, static thickeners and high-speed centrifuges with the clarified process water being returned to the feed end of the process.

As the process water continues to be recycled its solids gradually build up until the amount of very finely divided solids removed per unit of time in the form of dry end products (clean coal and reject) equals the rate at which very finely divided solids of the same composition enters the structure with the raw coal at which time a steady state is established.

As a high content of very finely divided solids in the recirculating process water tends to detract from its quality as a medium, the overall efficiency of the gravimetric separation of the beneficiation plant is adversely affected by excessive amounts of these fines. In the recycling process, the efficiency of each separator affects the efficiency of all the other separators in the circuit. The problems resulting from this gradual or periodic contamination are conventionally solved by bleeding the very finely divided solids from the system and discharging them in a pond or the environment in the form of a sludge containing a portion of the process water. The invention derives from a method described in a previously published paper (J. L. Picard, "Coal Watery Design - II, The Computation of Recirculating Loads" Tech. Bull. T. B. 142, Dept. of Energy, Mines and Resources, Mines Branch, Ottawa, Ontario, Canada 1971) whereby the steady state of the process is expressed by the recirculation coefficient which is circulated in advance from the known characteristic error curves of the individual separators (sorters and sizers) and the known washability characteristics of the plant feed, to the effect that the load on each individual separator can be estimated in advance for a structure operating under steady-state conditions. The overall efficiency of the operation is influenced by variations in the feed composition and its effect on the steady state. For example, when the amount of very fine material in the feed (e.g. clay) increases significantly, the sizers 47 and 48 may become overloaded, with the result that process water returning via line 52 contains more clay and becomes more viscous, which in turn, may affect the sorters (cyclones 31, 32, 42, 43) to a noticeable degree, which in turn, affects the sizers, and so on. It is therefore important for the trouble-free operation of the structure that the separators have a high tolerance for overload, especially an overload of very finely divided solids, such as fine coal slimes and clay. For this reason, it is preferred that the sorters be compound water cyclones as described in two previously published papers (J. Visman and D. Riva, "Integrated Process for the Beneficiation of Friable Smalls", Trans. 6th Int. Coal Preparation Congress, Paris 1973, paper 6E; and J. Visman and M. W. Mikhail, "Sulfur Reduction of Coking Coal from Cape Breton", Trans. 7th Int. Coal Preparation Congress Sydney, Australia, 1976, paper E2).

The results obtained with the above method show that the overall efficiency as expressed by the returns per ton of raw coal processed, are favourably affected because:

(a) complete recovery of the very fine slimes increases the overall yield of clean coal. There are many examples of sludge ponds containing recoverable coal that was discarded because of the complications of recirculation of process water and the build-up of very finely divided solids interfering with the overall efficiency of the process.

(b) the amount of very finely divided solids contained in the recycled process water can be allowed to build up and vary considerably without detriment to efficiency when using centrifugal separators operated with water only such as the compound water cyclone, which is known to have a high tolerance for slimes compared to conventional separators operated by gravity.

(c) the plant size and the capital cost per ton/hr installed capacity are reduced by comparison to conventional plants as the volume of process water is reduced to the minimum and no outside pond is required, with the attendant cost of operating and maintaining it. As well, the environmental hazards of external water recovery from ponds are eliminated at the source.

The process applies to any selection of sorters and sizers, except in this regard that the overall efficiency of the process depends on the choice of these separators. Therefore, while the use of compound water cyclones, pulp divider, oil-agglomeration, cyclonic flocculation and slugging cyclones is preferred, the process in principle is operable using a wide variety and type of sorters and sizers. With internal recirculation of process water under steady-state conditions and zero discharge of pollutants, the joint action of the assembled sorters and sizers produces a beneficial, synergistic effect whereby the overall operating cost per ton of feed is reduced and the overall efficiency is enhanced.

The invention thus refers to a system in which the phenomena are integrated in such a fashion as to constitute a functional unit with properties not derivable from its parts. This mechanism operates by causing certain intermediate, unfinished products to recirculate between various parts of the system.

Part 2 depends on part 1 for its feed but part 1 requires part 2 for maintaining proper operating conditions. Thus, the operation of the system as a whole is improved, each part reinforcing the other and rendering it a total process.

I claim:

1. A method for the beneficiation of crushed raw coal with the concomitant elimination of solids-containing liquid waste streams which comprises:

(a) slurrying the crushed raw coal in water and subjecting the slurried coal to a first gravimetric separation whereby a light fraction comprising clean coal and a heavy coal and waste containing fraction are produced;

(b) subjecting said light fraction to a first granulometric separation to produce a fine coal-containing fraction and a coarse, clean, coal product fraction;

(c) subjecting said heavy coal and waste fraction to a second gravimetric separation to produce a middlings fraction and a heavy waste solids containing fraction;

(d) dewatering both said middlings fraction and said heavy waste solids containing fraction, recycling said middlings fraction to the first gravimetric separation and passing said dewatered heavy solids fraction from the process as reject waste;

(e) subjecting the liquid stream obtained by dewatering said middlings fraction to a third gravimetric separation to produce a light fraction containing finely divided coal and a heavy fraction containing waste solids;

(f) subjecting said light fraction containing finely divided coal to a second granulometric separation to produce a coal sludge fraction and a reject effluent fraction containing finely divided waste material;

(g) agglomerating said coal sludge fraction and dewatering it to produce a clean fine coal product fraction, and a waste-containing effluent fraction;

(h) recycling said waste-containing effluent fraction to said third gravimetric separation;

(i) flocculating the solids in said reject effluent fraction and separating the flocculated solids to produce a reject cake and a clarified water stream, and (j) recycling said clarified water stream to the coal slurry feed to said first gravimetric separation.

2. The process of claim 1 wherein said heavy fraction containing waste solids of step (e) is subjected to a fourth gravimetric separation to produce a light coal-containing fraction and a heavy waste sludge fraction.

3. The process of claim 2 wherein said first, second, third and fourth gravimetric separations are accomplished by passing the feed streams to said separations through compound water cyclones.

4. The process of claim 1 wherein the fine coal-containing fraction of step (b) is recycled to the slurried coal fed to said first gravimetric separation.

5. The process of claim 1 wherein the dewatered middlings fraction of step (d) is further comminuted by grinding before being recycled to said first gravimetric separation.

6. The process of claim 5 wherein said light coal-containing fraction is recycled to said third gravimetric separation and wherein said waste sludge fraction is dewatered to produce a reject cake and a reject effluent.

7. The process of claim 6 wherein said reject effluent is flocculated and thereafter separated to produce a reject cake and a clarified water stream for recycle.

8. The process of claim 1 wherein said coal sludge fraction is agglomerated by the addition of a small amount of oil.

9. The process of claim 1 wherein said flocculated solids in said reject effluent fraction are separated by treatment in a static thickener to produce clarified process water for recycle and a sludge which is further dewatered by treatment in a slugging centrifuge to produce a reject waste cake and additional clarified process water.

10. The process of claim 1 wherein said coarse coal product fraction and said fine coal product fraction are blended.

* * * * *

UNITED STATES PATENT AND TRADEMARK OFFICE

CERTIFICATE OF CORRECTION

PATENT NO. : 4,133,747

DATED : January 9, 1979

INVENTOR(S) : Jan Visman

It is certified that error appears in the above-identified patent and that said Letters Patent are hereby corrected as shown below:

In the drawings, Figure 2 should appear as shown on the attached sheet.

Column 4, lines 50 and 51, "circulated" should read

-- calculated --.

Signed and Sealed this

Tenth Day of July 1979

[SEAL]

Attest:

Attesting Officer

LUTRELLE F. PARKER

Acting Commissioner of Patents and Trademarks

UNITED STATES PATENT AND TRADEMARK OFFICE

CERTIFICATE OF CORRECTION

PATENT NO. : 4,133,747

DATED : January 9, 1979

INVENTOR(S) : Jan Visman

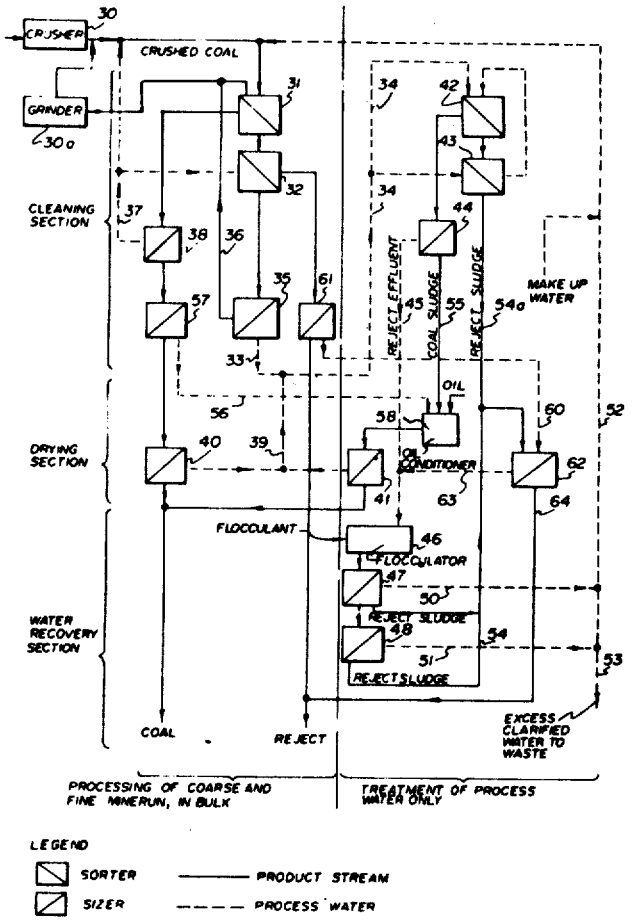

It is certified that error appears in the above-identified patent and that said Letters Patent are hereby corrected as shown below: